US006848544B2

(12) United States Patent
Bloch

(10) Patent No.: US 6,848,544 B2
(45) Date of Patent: Feb. 1, 2005

(54) METHOD AND EQUIPMENT FOR THE EVACUATION OF LIFT PASSENGERS

(75) Inventor: Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 177 days.

(21) Appl. No.: 10/043,953

(22) Filed: Jan. 10, 2002

(65) Prior Publication Data

US 2002/0100645 A1 Aug. 1, 2002

(30) Foreign Application Priority Data

Jan. 26, 2001 (EP) ..... 01810076

(51) Int. Cl.[7] ..... B66B 1/02
(52) U.S. Cl. ..... 187/306
(58) Field of Search ..... 187/306, 263, 187/377, 290, 298, 311

(56) References Cited

U.S. PATENT DOCUMENTS

| | | | | | |
|---|---|---|---|---|---|
| 604,360 | A | * | 5/1898 | Bell | 187/306 |
| 1,167,140 | A | * | 1/1916 | Willis | 187/259 |
| 1,206,764 | A | * | 11/1916 | Rover | 251/31 |
| 6,196,355 | B1 | * | 3/2001 | Fargo et al. | 187/393 |
| 6,336,523 | B1 | * | 1/2002 | Ozeki et al. | 187/391 |
| 6,352,136 | B1 | * | 3/2002 | Shih | 187/250 |
| 6,364,066 | B1 | * | 4/2002 | Bolch et al. | 187/391 |
| 6,425,461 | B1 | * | 7/2002 | Wang | 187/290 |
| 6,427,809 | B2 | * | 8/2002 | Bammert | 187/391 |
| 6,464,041 | B1 | * | 10/2002 | Chen | 187/290 |

FOREIGN PATENT DOCUMENTS

| | | | |
|---|---|---|---|
| DE | 261971 | | 7/1913 |
| DE | 26 40 137 | A1 | 3/1978 |
| DE | 3446657 | A1 | 8/1985 |
| FR | 1407529 | | 6/1965 |
| JP | 4-7284 | * | 1/1992 |
| LU | 87708 | | 3/1990 |

OTHER PUBLICATIONS

Patent Abstracts of Japan, Pub. No. 08099780, Apr. 16, 1996 "Rope Type Linear Motor Elevator".

* cited by examiner

*Primary Examiner*—Jose V. Chen
(74) *Attorney, Agent, or Firm*—Schweitzer Cornman Gross & Bondell LLP

(57) ABSTRACT

A method and equipment is provided to allow a stuck elevator lift cage to be moved in situations when the lift cage and passengers is in weight equalization with the lift counterweight. With the lift's safety brake dis-engaged and the lift drive unactuated, the drive brake is released and an additional force is applied to the lift cage from a source external to the lift drive to move the lift cage to a position for passenger evacuation. The additional force may be applied through a cable pull connected to the limiter cable of the elevator's speed monitor system.

10 Claims, 3 Drawing Sheets

METHOD AND EQUIPMENT FOR THE EVACUATION OF LIFT PASSENGERS

The present invention relates to a method and equipment for the evacuation of lift passengers trapped in a lift cage which is stuck, wherein the lift cage is moved to a story or to a position near a story.

BACKGROUND OF THE INVENTION

An auxiliary travel device for lifts has become known from laid-open specification DE 26 40 137 which, in the case of a lift cage remaining stuck, makes an emergency alighting from the lift cage possible for the passengers trapped in the lift cage. A rotatable roller on which a reserve length of the support cable is wound up is arranged at the lift cage. The roller is operable from the lift cage by way of a transmission. The support cable is unwound by rotation of the roller and the lift cage moved to the next lower story at which the passengers can leave the lift cage.

A disadvantage of such known equipment is that the emergency evacuation is not easily performed by the lift passengers themselves. Children or older passengers may be overtaxed by the operation of the roller for lengthening of the support cable. In addition, the support cable length necessary for the lift operation has to be reset by a skilled operator after an emergency evacuation.

BRIEF DESCRIPTION OF THE INVENTION

The present invention is intended to remedy the disadvantages of the prior art, and provides a method and apparatus by means of which passengers trapped in a stuck lift cage can be simply and safely evacuated. It is known to allow an imbalance between the lift cage and a counterweight to move the lift cage in an emergency condition. When the lift cage is in equilibrium with the counterweight, however, no force imbalance exists. In accordance with the present invention, in an emergency situation where a lift cage in equilibrium with the counterweight is stuck, a force imbalance is created and applied to the lift cage to allow the lift cage to be moved without powering the elevator drive.

The advantages achieved by the invention are essentially to be seen in that an expensive emergency drive acting by way of the drive pulley on the drive cable is not necessary for the evacuation of the lift passengers. It is further of advantage that existing shaft fittings can be used for the evacuation. The evacuation can be readily carried out by simple means.

BRIEF DESCRIPTION OF THE DRAWINGS

The present invention is explained in more detail by reference to the accompanying figures, in which.

DETAILED DESCRIPTION OF THE INVENTION

Figure 1:
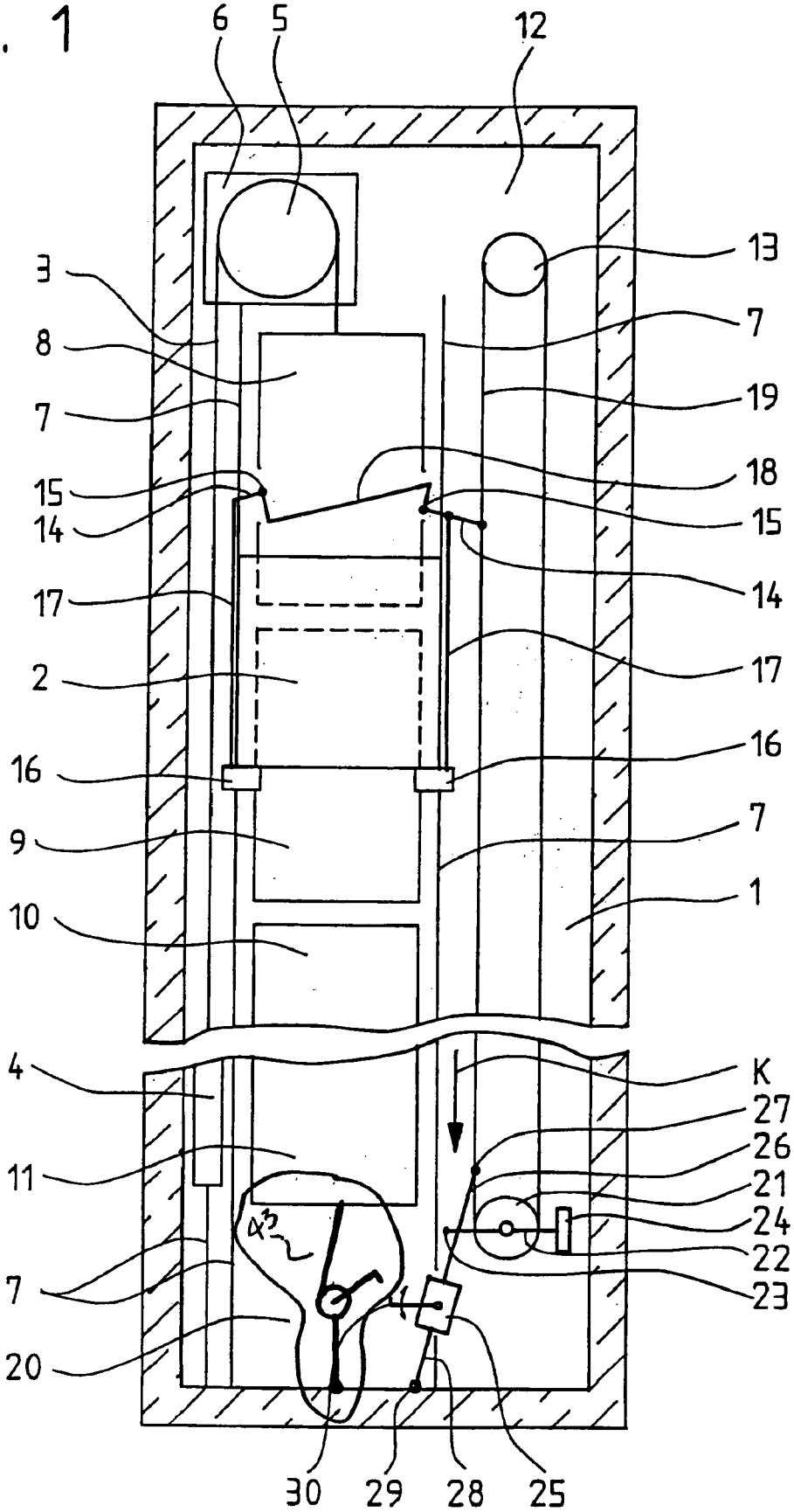
FIG. 1 is a diagrammatic illustration of a lift with a cable pull for evacuation of lift passengers in accordance with the invention.

FIG. 1 shows a lift installation with a lift cage 2 which travels in a lift shaft 1 and which is connected by way of a cable 3 with a counterweight 4. The cable 3 is driven in the operational case by means of a drive pulley 5 of a drive unit 6. The cage 2 and counterweight are guided by means guide rails 7 extending over the height of the shaft. The lift installation comprises an uppermost story with an uppermost story door 8, a second-uppermost story with a second-uppermost story door 9, further stories with further story doors 10 and a lowermost story with a lowermost story door 11. Arranged in a shaft head 12 is the drive unit 6 and a speed limiter 13, which monitors the speed of the lift cage 2 and stops the lift cage 2 in the case of excess speed. A respective double lever 14, which is pivoted at a fulcrum 15, is provided at each side of the lift cage 2. A safety brake 16 provided for stopping the lift cage 2 is connected by means of a rod 17 to one side of the double lever 14, which side is also connected to a limiter cable 19 of the speed limiter 13. The other side of one double lever 14 is connected by means of a rod 18 with the other double lever. If the one side of the double lever 14 is moved upwardly, then the safety brake 16 is engaged, wherein blocking elements wedging with the guide rail 7 arrest the lift cage 2 in the case of emergency. In the operational case the lift cage 2 drives the limiter cable 19 by means of the double lever 14. The speed limiter 13 blocks the limiter cable 19 in the case of excess speed of the lift cage 2. The double lever 14 is thereby pivoted upwardly and the safety brake 16 engaged at both sides of the lift cage 2.

The endless limiter cable 19 is tensioned by means of a deflecting roller 21 arranged in a shaft pit 20, wherein a roller axle 22 is pivoted at one end at a fulcrum 23 and carries a counterweight 24 at the other end.

FIG. 1 shows the lift cage 2, together with lift passengers, stuck between, by way of example, the uppermost story and the second-uppermost story. The safety brake 16 is not engaged. The drive unit 6 is free of power and is braked by means of a brake of the drive unit 6. The brake can be released, for example, manually. If the lift cage 2 together with the lift passengers prevails over the counterweight 4 in terms of weight, the lift cage 2 moves downwardly if the brake is released. The trapped lift passengers can leave the lift cage 2 at the second-uppermost storey or at a position near the storey. If the counterweight 4 prevails in terms of weight over the lift cage 2 together with the lift passengers, the lift cage 2 moves upwardly if the brake is released. The trapped lift passengers can then leave the lift cage 2 at the uppermost storey or at a position near the storey.

If, however, the lift cage 2 together with the lift passengers is in equilibrium with the counterweight 4, the lift cage 2 remains stationary when the brake is released. In this case an additional force K has to act on the lift cage 2 for the evacuation of the lift passengers. The friction forces of the drive unit 6, the counterweight guides and the lift cage guides are overcome by the additional force K and the lift cage 2 is drawn downwardly.

For producing the additional force K a cable pull 25 can be used, which is connected at one end to the limiter cable 19 and anchored at the other end in the shaft pit 20. A traction cable 26 of the cable pull 25 is connected to the limiter cable 19 by means of a manually-operable cable clamp 27 and is connected with an anchorage point 29 of the shaft pit 20 by means of an anchoring cable 28. In the case of weight equalization between the lift cage 2 together with the lift passengers and the counterweight 4, one person releases the brake of the drive unit 6 and a further person climbs into the shaft pit 20 and actuates a crank 30 of the cable pull 25, whereby the lift cage 2 is drawn by means of the cable pull 25 to the second-uppermost storey. If the lift cage 2 automatically moves downwardly after overcoming the friction, the lift cage can be braked by means of the brake of the drive unit 6. In an emergency case the limiter cable 19 blocks, and the safety brake 16 engages, as soon as the cable clamp 27 reaches the roller axle 22.

For producing the additional force K there can be provided, instead of the cable pull 25, a cable or belt 43 which is arranged at the lift cage 2 and preferably anchored in the shaft pit 20 and which in the operational case can be unrolled and extended by the upward movement of the lift cage 2 and rolled up and retracted by the downward movement of the lift cage 2. In the case of weight equalization between the lift cage 2 together with the lift passengers and the counterweight 4, one person releases the brake of the drive unit 6 and a further person climbs into the shaft pit 20 and draws the lift cage 2 by means of the cable or belt to the second-uppermost story. This procedure is suitable particularly for smaller lift installations with smaller lift cages. The cable or belt can be arranged at the counterweight 4 instead of at the lift cage 2. The lift cage 2 is then drawn to the next-higher story.

FIG. 1 shows a lift installation without an engine room. The equipment according to the inventions for evacuation of lift passengers can also be used for a lift installation with an engine room.

Figure 2:
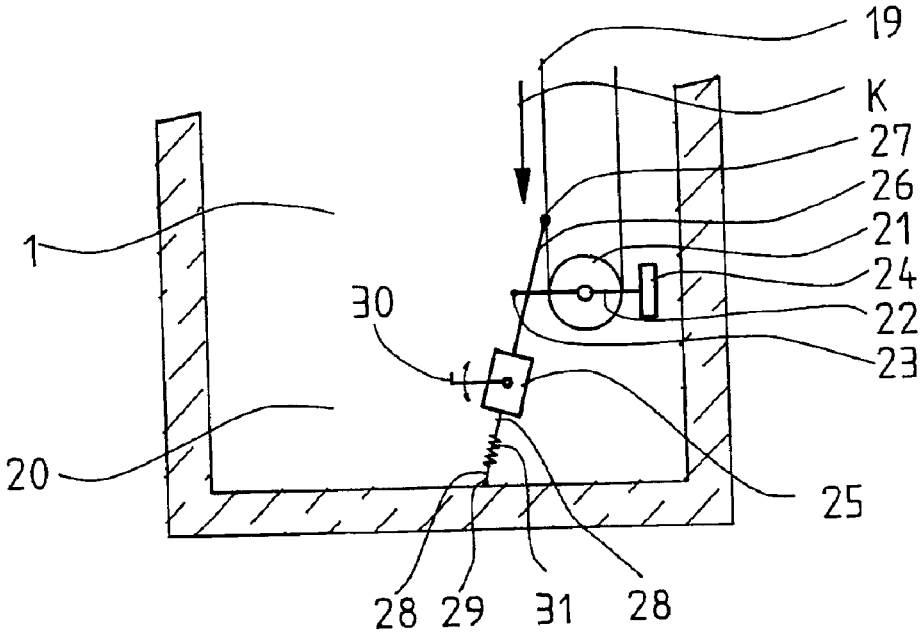
FIG. 2 is a diagrammatic illustration of an embodiment of the invention in which the cable pull is in conjunction with an energy storage device for movement of the stuck lift cage.

FIG. 2 shows the cable pull 25 in conjunction with an energy storage device for moving a lift cage 2 which is stuck. A tension spring 31, for example, is provided as the energy storage device. Other energy storage devices, such as pneumatic or hydraulic force storage devices, are also conceivable. Before the release of the brake of the drive unit 6 the spring 31 is tensioned by means of the cable pull 25 and the brake is released thereafter. The spring force of the tension spring 31 acts by means of the limiter cable 19 on the lift cage 2 until the lift cage arrives at the second-uppermost story or at a position near the story.

Figure 3:
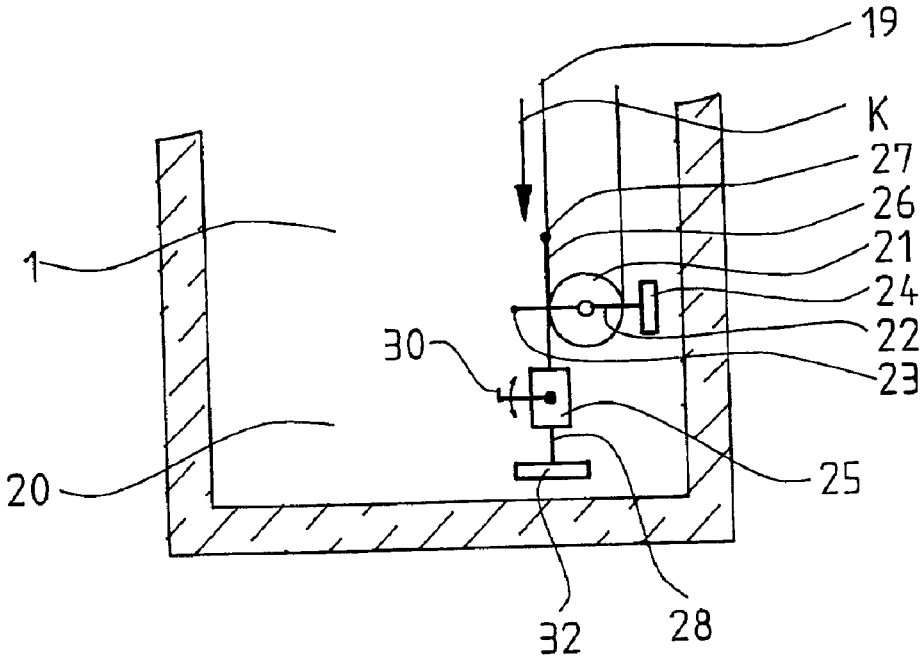
FIG. 3 is a diagrammatic illustration of an embodiment of the invention in which a cable pull is in conjunction with an auxiliary weight for movement of the stuck lift cage.

As shown in FIG. 3, the tension spring 31 can be replaced by a weight 32. Before release of the brake the weight 32 is raised from the floor of the shaft pit by means of the cable pull 25. After release of the brake the weight 32 applied to the limiter cable 19 draws the lift cage 2 downwardly. The weight 32 can also lie on the floor of the shaft pit 20 and serve as an anchorage point.

Only one person is necessary for the evacuation of the lift passengers in the variants of embodiment of FIGS. 2 and 3.

Figure 4:
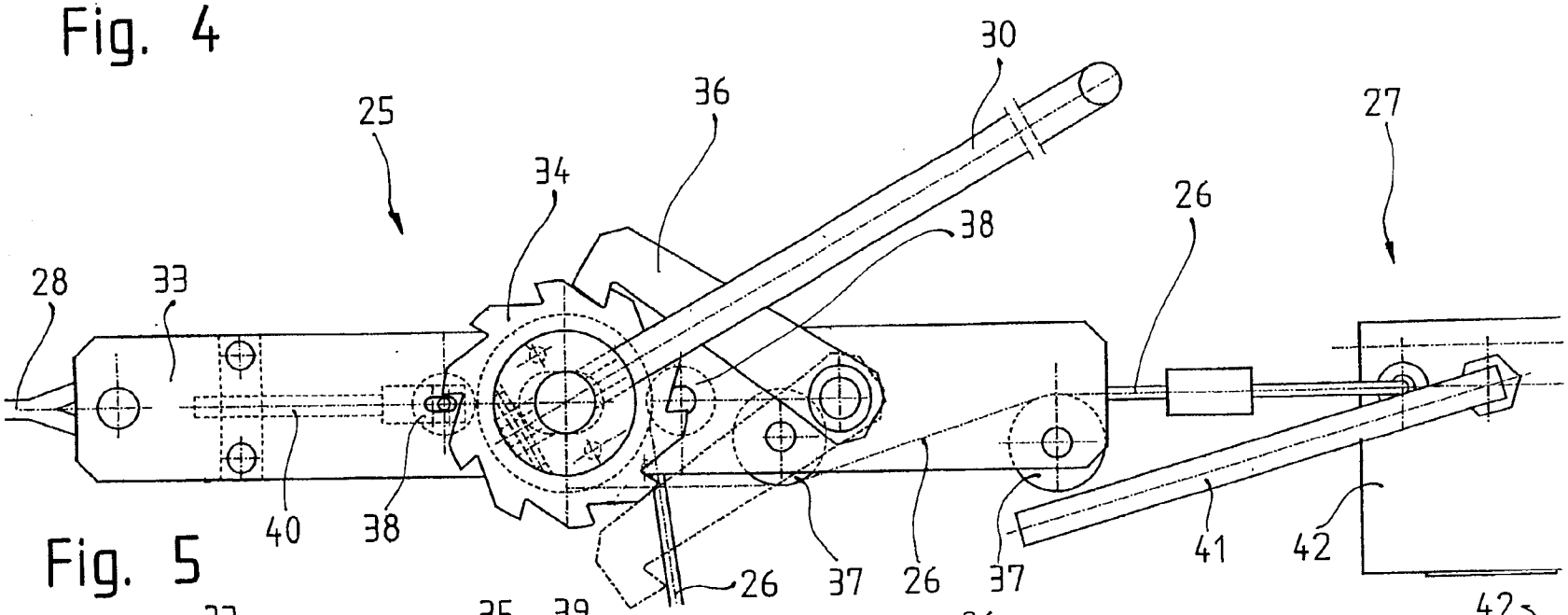
FIG. 4 shows a side detail view of the cable pull.
Figure 5:
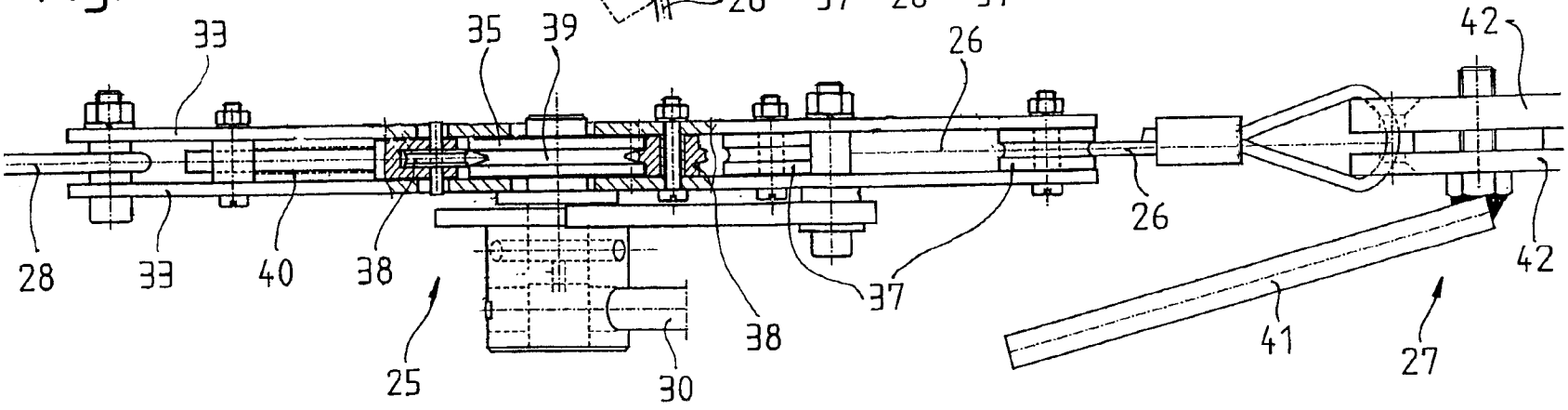
FIG. 5 shows a plan view of the cable pull.

FIGS. 4 and 5 show details of the cable pull 25, which substantially consists of two side plates 33 and a drive roller 35 driven by means of a ratchet wheel 34, wherein the cable pull 26 loops around the drive roller 35 by somewhat more than 270°. The ratchet wheel 34 is driven by means of the crank 30, wherein rotation in one direction can be blocked by means of a pawl 36. The traction cable 26 is guided at the entry side by means of guide rollers 37 and pressed into a groove 39 of the drive roller 35 by means of pressure rollers 38, wherein one pressure roller 38 is acted on by means of a spring force of a compression spring 40. The cable clamp 27 is actuable by means of a clamping lever 41, wherein two clamping plates 42 firmly clamp the limiter cable 19. The illustrated cable pull 25 is independent of cable length and load-dependent with the groove 39 of the drive roller 25. A motorized drive can also be provided instead of the crank 30 or the illustrated cable pull 25.

I claim:

1. A method for the evacuation of lift passengers trapped in a lift cage having a drive unit and weight equalization with a counterweight by moving the lift cage to a story or to a position near a story, characterised by the production of an additional force by a force-generating device at a location remote from the drive unit and which does not emanate from a drive pulley of the drive unit for the lift cage and coupling the force to the lift cage through a cable or belt to move the counterweight and the lift cage to a next adjacent story when a brake of the drive unit is released.

2. The method according to claim 1, characterized in that the force-generating device is a cable pull.

3. The method according to claim 2, characterized in that the cable pull acts on a limiter cable of a speed limiter, wherein the limiter cable is coupled to a safety brake of the lift cage.

4. Equipment for the evacuation of lift passengers trapped in a lift cage having a drive unit and weight equalization with a counterweight by moving the lift cage to a story or to a position near a story, comprising means for producing an additional force remote from the drive unit and not emanating from drive pulley of a drive unit for the lift cage and for applying the additional force to act on the lift cage when a brake of the drive unit is released.

5. The equipment according to claim 4, wherein the force-producing means comprise a retractable cable or belt coupled to the lift cage.

6. The equipment according to claim 4, wherein the force-producing means comprises a cable pull.

7. The equipment according to claim 6, wherein the force-producing means further comprises a limiter cable of a speed limiter coupled to a safety brake of the lift cage.

8. The equipment according to claim 6 or 7, further comprising a motorized actuator for the cable pull.

9. The equipment according to claim 6 or 7, further comprising a manual actuator for the cable pull.

10. The equipment according to claim 4 wherein the force-producing means includes an energy storage device.

* * * * *